US011254135B2

(12) United States Patent
Iinuma et al.

(10) Patent No.: US 11,254,135 B2
(45) Date of Patent: Feb. 22, 2022

(54) LIQUID STORAGE CONTAINER

(71) Applicant: CANON KABUSHIKI KAISHA, Tokyo (JP)

(72) Inventors: Keisuke Iinuma, Yokohama (JP); Tatsuo Nanjo, Kawasaki (JP); Wataru Takahashi, Yokohama (JP); Kenta Udagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/816,028

(22) Filed: Mar. 11, 2020

(65) Prior Publication Data

US 2020/0298575 A1 Sep. 24, 2020

(30) Foreign Application Priority Data

Mar. 19, 2019 (JP) ..... JP2019-051133

(51) Int. Cl.
*B41J 2/175* (2006.01)

(52) U.S. Cl.
CPC ..... *B41J 2/17523* (2013.01); *B41J 2/17553* (2013.01)

(58) Field of Classification Search
CPC .... B41J 2/175; B41J 2/17509; B41J 2/17513; B41J 2/1752; B41J 2/17523; B41J 2/17553; B41J 29/02
See application file for complete search history.

(56) References Cited

U.S. PATENT DOCUMENTS 5,384,173 A * 1/1995 Akao ..... G03C 3/00 220/669
6,634,738 B1 * 10/2003 Shinada ..... B41J 2/17523 347/86
2002/0075367 A1 6/2002 Chiu
2008/0198211 A1 * 8/2008 Aoki ..... B41J 2/17509 347/86

FOREIGN PATENT DOCUMENTS

CN 1350624 A 5/2002
CN 1445093 A 10/2003
CN 1537724 A 10/2004
CN 1956898 A 5/2007
CN 101081564 A 12/2007
CN 101249755 A 8/2008

(Continued)

*Primary Examiner* — Anh T Vo
(74) *Attorney, Agent, or Firm* — Canon U.S.A., Inc. I.P. Division

(57) ABSTRACT

A sealing member is applied to the surface of a liquid storage container having a liquid supply port provided so as to be open to a concave space formed on the surface with a gap between the applied sealing member and the liquid supply ports so as to seal the concave space. The liquid supply port has a profile adapted to be inserted into and connected to a connecting portion for supplying liquid to the liquid supply port. A cut score section is formed on the sealing member as including a center point located at the position on the extension from the front end of the liquid supply port in the direction of connecting the liquid supply port to the connecting portion and the cut score section is torn as it is pressed by the connecting portion moving toward the liquid supply port.

14 Claims, 9 Drawing Sheets

(56) References Cited

FOREIGN PATENT DOCUMENTS

| | | | |
|---|---|---|---|
| CN | 102892683 | A | 1/2013 |
| CN | 103237661 | A | 8/2013 |
| CN | 106626789 | A | 5/2017 |
| JP | 2017-007268 | A | 1/2017 |
| JP | 2017-081078 | A | 5/2017 |
| WO | 2014-066723 | A1 | 5/2014 |

* cited by examiner

LIQUID STORAGE CONTAINER

BACKGROUND OF THE INVENTION

Field of the Invention

The present disclosure relates to a liquid storage container.

Description of the Related Art

Tube supply systems are known as a sort of liquid supply system that can be used for liquid discharge heads in the field of liquid discharge apparatus comprising a liquid discharge head for ejecting liquid such as ink. When a tube supply system is employed, the main tank arranged in the main body of a liquid discharge apparatus and a liquid discharge head are connected to each other by way of tubes. The liquid contained in the main tank is supplied to the liquid storage container of the liquid discharge head by way of the tubes for the purpose of supplying the liquid discharge head with liquid. When a tube supply system is adopted, the liquid storage container of the liquid discharge head is provided with a plurality of liquid supply ports that are to be removably connected to the respective tubes arranged on the side of the main body. The liquid storage container is already filled with liquid, which may typically be ink, when the tubes are fitted to the liquid storage container. Japanese Patent Application Laid-Open No. 2017-081078 discloses a technique of applying label members to the respective liquid supply ports of the liquid storage container for the purpose of sealing the liquid supply ports and preventing liquid from leaking and evaporating from the liquid supply ports of the liquid storage container before fitting the tubes to the liquid supply ports. In a liquid discharge apparatus described in Japanese Patent Application Laid-Open No. 2017-081078, liquid is supplied to the liquid storage container by way of the tubes by an amount equal to the amount that has flown out from the liquid storage container so as to be discharged from the liquid discharge head. Therefore, due to the above-described arrangement, the liquid discharge apparatus can continuously be operated for use.

With the technique described in Japanese Patent Application Laid-Open No. 2017-081078, when connecting the tubes to the liquid storage container in order to supply liquid to the liquid storage container, the labels applied to the liquid supply ports need to be peeled off to expose the liquid supply ports. Such an operation of peeling off the labels is a time consuming operation that affects the efficiency of using the liquid discharge apparatus.

SUMMARY OF THE INVENTION

A liquid storage container according to the present disclosure is capable of containing liquid in the inside thereof and receiving the liquid from a connecting portion and has on the surface thereof a liquid supply port cpnfigured to supply the liquid, the liquid supply port being arranged so as to be open to a concave space formed on the surface of the container, a sealing member being applied to the surface of the container to close the concave space, the sealing member being spaced apart from the liquid supply port; the liquid supply port having a protruding profile so as to be inserted into the connecting portion of a liquid supply path configured to supply liquid to the liquid supply port and thereby connected to the connecting portion; the sealing member being provided with a cut score section formed thereon; the cut score section including a center point located on the extension of the line connecting the front end of the liquid supply port and the connecting portion, the cut score section being a region tearable so as to be opened by a pressure applied by the connecting portion on the way of moving toward the liquid supply port.

Further features of the present disclosure will become apparent from the following description of exemplary embodiments with reference to the attached drawings.

DESCRIPTION OF THE EMBODIMENTS

Figure 1:
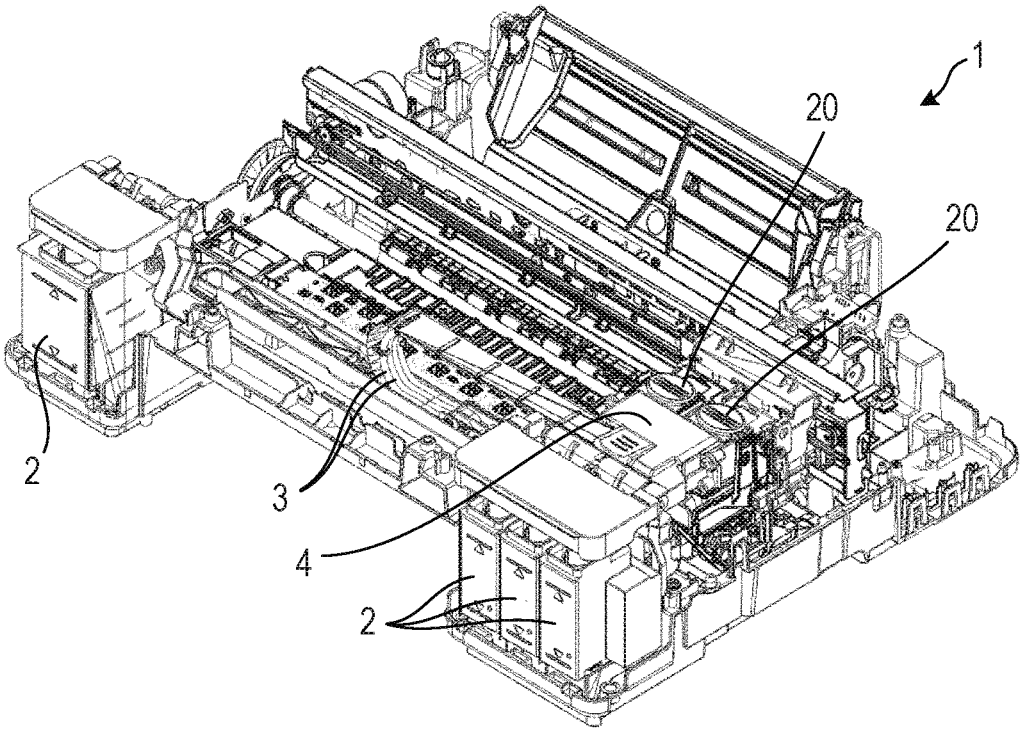
FIG. 1 is a schematic perspective view of a liquid discharge apparatus to which the present disclosure is applicable, illustrating the overall configuration of the apparatus.

An aspect of the present disclosure is to provide a liquid storage container having a sealing member applied to the surface of the container for the purpose of minimizing the leakage and the evaporation of liquid from the liquid supply ports of the liquid storage container, which is so designed that the tubes for supplying liquid can be connected to the respective liquid supply ports without peeling off the sealing member.

Now, embodiments of the present disclosure will be described below in detail by referring to the drawings. A liquid storage container according to the present disclosure may typically be arranged in a liquid discharge head to be mounted in a liquid discharge apparatus so as to contain the liquid to be ejected from the liquid discharge head and also to be supplied with liquid from the main body of the liquid discharge apparatus by way of tubes. While a liquid storage container according to the present disclosure is arranged in a liquid discharge head throughout the following description of the present disclosure, a liquid storage container according to the present disclosure may not necessarily be arranged in a liquid discharge head. In other words, a liquid storage container according to the present disclosure is not limited to one to be arranged in the liquid discharge head.

Figure 2:
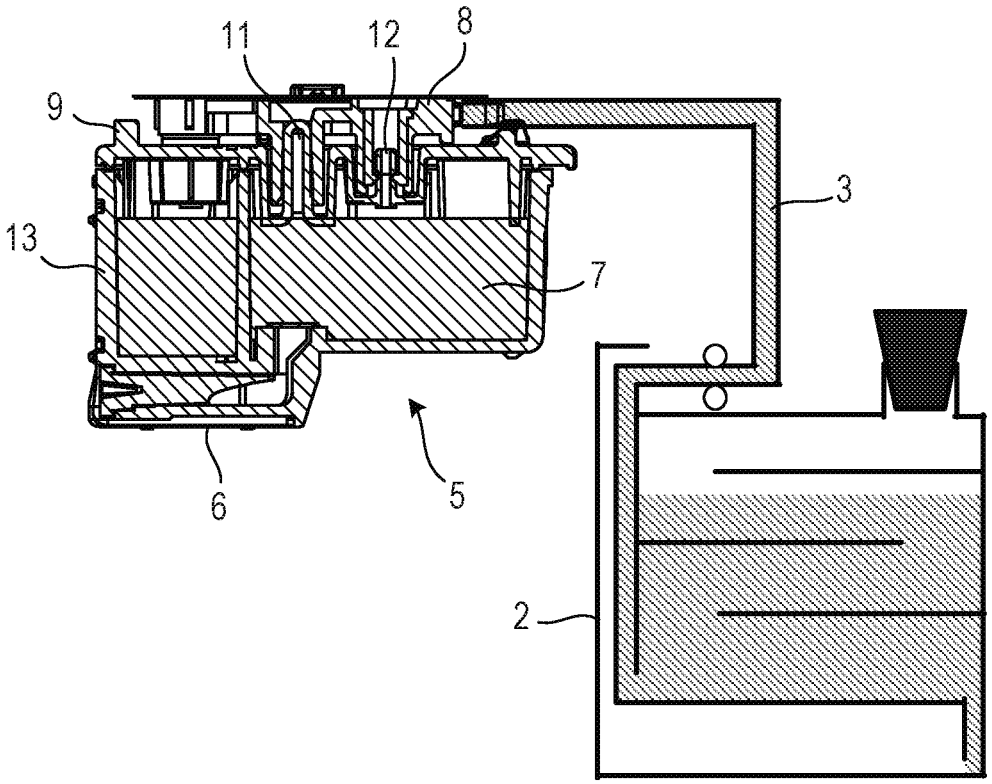
FIG. 2 is a schematic illustration of the liquid supply system of the liquid discharge apparatus of FIG. 1.

Before describing a liquid storage container according to the present disclosure, a liquid discharge apparatus to which the present disclosure is applicable will be described first. FIG. 1 is a schematic perspective view of liquid discharge apparatus 1 to which the present disclosure is applicable, illustrating the overall configuration of the apparatus, and FIG. 2 is a schematic illustration of the liquid supply system of the liquid discharge apparatus 1 shown in FIG. 1. As shown in FIG. 1, the liquid discharge apparatus 1 comprises a main tank 2 for storing liquid such as ink, tubes 3, each of which has one of its opposite ends connected to the main tank 2, and a carriage 4 that can reciprocatively be moved along the main body of the liquid discharge apparatus 1. A liquid discharge head 5 (see FIG. 2) is mounted on the carriage 4 and the tubes 3 are employed to supply liquid from the main tank 2 to the liquid discharge head 5. The tubes 3 are made of a flexible material so as to make it possible to follow the reciprocating movement of the carriage 4. The carriage 4 is equipped with joints 8 (see FIG. 2) for connecting themselves to the liquid discharge head and operation control joint levers 20 are arranged on the top surface of the carriage 4. Referring to FIG. 2, as the joint levers 20 are pushed down, the joints 8 are forced to move downward to become connected to the liquid discharge head 5. As the joints 8 are connected to the liquid discharge head 5, the liquid discharge head 5 is snugly mounted on the carriage 4. As shown in FIG. 2, the other end of each of the tubes 3 is connected to the corresponding one of the joints 8 of the carriage 4. Thus, as the liquid discharge head 5 is mounted on the carriage 4, the liquid discharge head 5 is brought into communication with the main tank 2 by way of the joints 8 and the tubes 3. FIG. 2 illustrates a state where the liquid discharge head 5 is mounted on the carriage 4 and brought into communication with the main tank 2 by way of the tubes 3.

The liquid discharge head 5 comprises a recording element board 6, which typically operates as a liquid discharge section for ejecting liquid for the purpose of recording an image on a recording medium, and a liquid storage container 7, which is a liquid storage section for storing the liquid to be ejected. In the illustrated instance, the recording element board 6 and the liquid storage container 7 are formed as an integral unit such that when the liquid discharge head 5 is mounted on the carriage 4, the recording element board 6 is located under the liquid storage container 7 as viewed in the direction of gravity. As far as this specification is concerned, the direction of gravity refers to the direction of gravity when the liquid storage container is in use (and hence when the liquid storage container is mounted in the liquid discharge apparatus). Differently stated, the liquid storage container 7 includes the recording element board 6. Liquid is supplied from the liquid storage container 7 to the recording element board 6 and, in the recording element board 6, ejection energy is given to the liquid to be ejected according to the recording signal given to it. As the ejection energy is given to the liquid, the liquid is ejected from the liquid discharge head 5. As the liquid is ejected, negative pressure arises in the inside of the liquid storage container 7. As pointed out above, the liquid discharge head 5 is connected to the main tank 2 by way of the joints 8 and the tubes 3. The main tank 2 stores the liquid to be supplied to the liquid discharge head 5 and is held in communication with the atmosphere. Thus, as the negative pressure in the inside of the liquid storage container 7 rises as a result of the liquid discharge from the recording element board 6 of the liquid discharge head 5, air is introduced into the main tank 2 accordingly. Then, as a result of the introduction of air, the liquid in the main tank 2 is supplied to the liquid storage container 7 by way of the tubes 3 and the joints 8. In this way, the liquid in the main tank 2 can continuously be supplied to the liquid storage container 7 during the image recording operation that is being performed by the liquid ejected from the liquid discharge head 5.

Figure 3A:
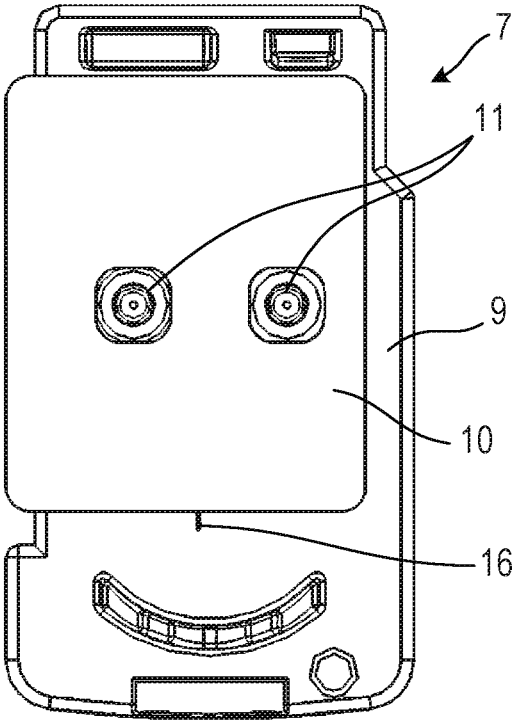
FIGS. 3A and 3B are schematic top views of a liquid storage container according to the present disclosure.
Figure 3B:
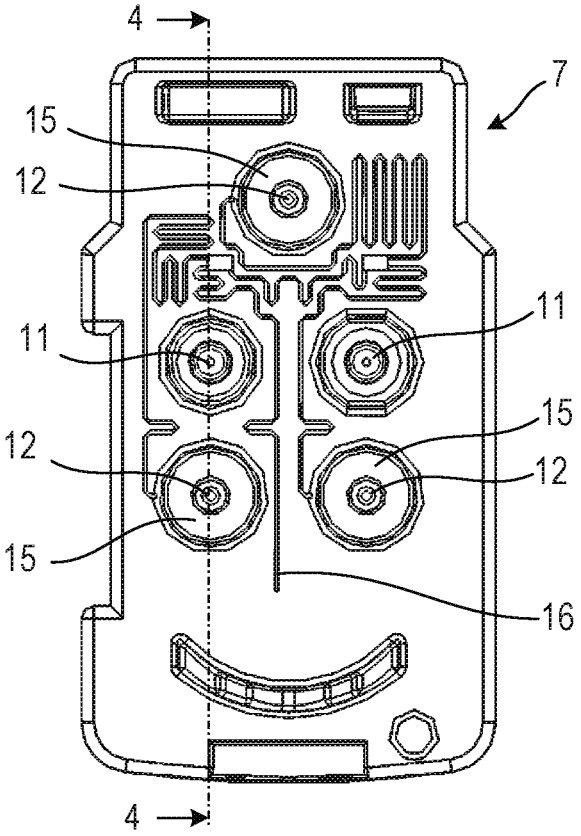
Figure 4:
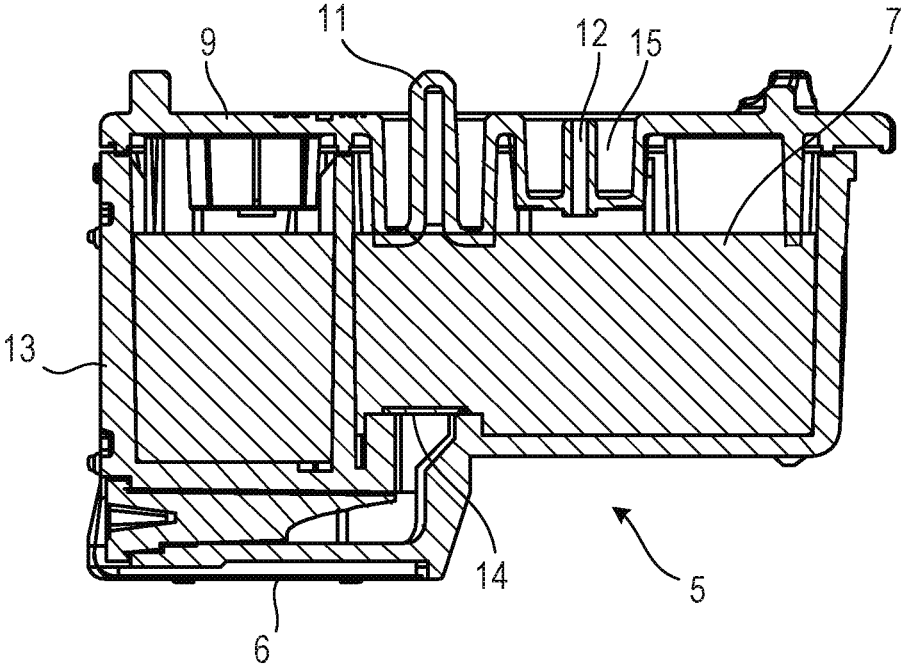
FIG. 4 is a schematic cross-sectional view of the liquid storage container taken along line 4-4 in FIG. 3B.

FIGS. 3A and 3B are schematic top views of a liquid discharge head 5 and hence they are schematic top views of a liquid storage container 7 arranged on the liquid discharge head 5. FIG. 3A shows the liquid storage container 7 with a sealing member 10 applied to it and FIG. 3B shows the liquid storage container from which the sealing member 10 has been peeled off. Note that FIGS. 3A and 3B illustrate a prior art liquid discharge head 5 and hence the sealing member 10 needs to be peeled off when the liquid discharge head 5 is mounted on the carriage 4. FIG. 4 is a schematic cross-sectional view of the liquid discharge head 5 taken along line 4-4 in FIG. 3B. As shown in FIGS. 3A, 3B and 4, the liquid discharge head 5 comprises a case member 13, a lid member 9, the case member 13 and the lid member 9 belonging to the liquid storage container 7, a recording element board 6 and a filter 14. The case member 13 is a box-shaped member whose top is open and the lid member 9 is welded to the top edges of the case member 13 to close the open top of the case member 13. An absorber, which is a capillary member and absorbs and holds liquid in it, and a filter 14 are arranged in the inside of the liquid storage container 7. The filter 14 is provided to minimize the foreign objects including pieces of garbage that are contained in the liquid in the liquid storage container 7 and trying to get into the recording element board 6. The absorber is typically a fiber absorber. In the illustrated instance, the recording element board 6 is arranged at the bottom of the case member 13 as viewed in the direction of gravity in a state where the liquid storage container 7 is in use.

Liquid supply ports 12 are formed on the surface of the lid member 9 and hence on the top surface of the liquid storage container 7 so as to be removably fitted to the respective connecting portions 8*a* (see FIGS. 5A through 5C) of the joints 8 arranged on the carriage 4 for the purpose of supplying liquid from the main tank 2 to the inside of the liquid storage container 7. Positioning members 11 are also provided on the surface of the lid member 9 to respectively align the joints 8 and the corresponding liquid supply ports 12 when the joints 8 are connected to the liquid storage container 7. The joints 8 that are arranged on the carriage 4 are equipped with respective protruding connecting portions 8*a*. Each of the connecting portions 8*a* has a tubular cylindrical top end so as to be able to receive the corresponding one of the liquid supply ports 12. Each of the liquid supply ports 12 is a tubular member having a profile that makes it possible to be inserted into and connected to the corresponding one of the connecting portions 8*a*. Each of the liquid supply ports 12 is provided therearound with a recess (concave space) 15 having a circular opening for receiving the tubular cylindrical top end of the corresponding one of the connecting portions 8*a* when the liquid supply port 12 is inserted into the inside of the corresponding one of the joints 8. In the inside of the recess 15 of each of the liquid supply ports 12, the liquid supply port 12 is so formed as to extend in the direction perpendicular to the surface of the lid member 9 and the front end of the liquid supply port 12 is located a step below the top surface of the lid member 9 (a position located below as viewed in the direction of gravity). With this arrangement, the liquid supply port 12 does not project from the top surface of the lid member 9 and is open to the space in the inside of the recess 15. Additionally, a communication groove 16 that starts from the recesses 15 to meander around the recess 15 and communicates with the recesses 15 is formed on the top surface of the lid member 9.

When liquid discharge heads 5 of the type under consideration are shipped and distributed as finished products, the liquid storage containers 7 thereof have already been made to contain liquid therein. More specifically, when liquid discharge heads are shipped and distributed, a sealing member 10 has already been applied to the top surface of the lid member 9 of each of the liquid storage containers 7 as shown in FIG. 3A in order to minimize the risk of leakage and evaporation of the liquid in the liquid storage container 7 due to changes in the environment such as temperature changes before it is mounted on a carriage 4. Since the sealing member 10 is for minimizing the risk of leakage and evaporation of the liquid from the liquid supply ports 12, it is applied to the top surface of the lid member 9 so as to cover at least the liquid supply ports 12 and the recesses 15 formed around the respective liquid supply ports 12 and seal the recesses 15. The sealing member 10 is preferably applied to cover almost all the top surface of the lid member 9 except one of the ends of the communication groove 16 in order to prevent the sealing member 10 from inadvertently and unintentionally being peeled off while the liquid discharge head 5 is on the way of distribution. Additionally, since the opening at the top end of each of the liquid supply ports 12 is located below the top surface of the lid member 9, a gap is produced between the sealing member 10 and the opening of the liquid supply port 12 that is surrounded by a recess 15. Therefore, the sealing member 10 cooperates with the communication groove 16 to establish an atmospheric air communication path that allows the inside of the liquid storage container 7 to communicate with the atmosphere so as to make it possible to appropriately adjust changes in the internal pressure of the liquid storage container 7 that can arise due to ambient temperature changes and atmospheric pressure changes.

Figure 5A:
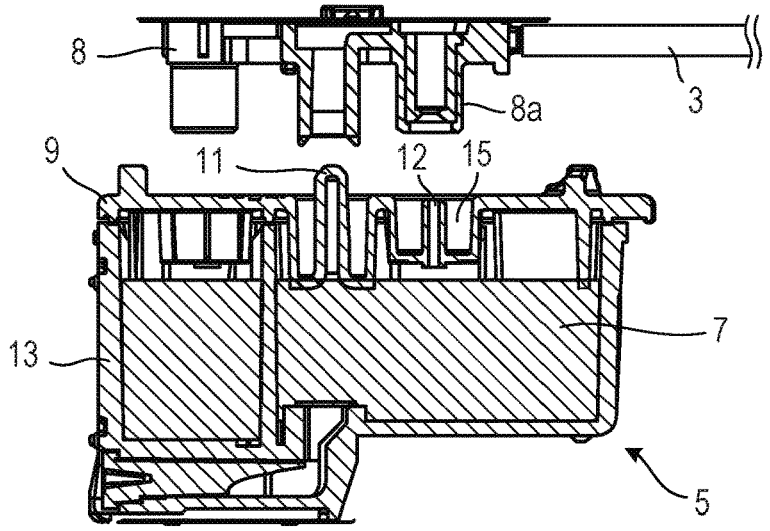
FIGS. 5A, 5B and 5C are schematic cross-sectional views of the liquid storage container, illustrating how each of the tubes is connected to the liquid storage container.
Figure 5B:
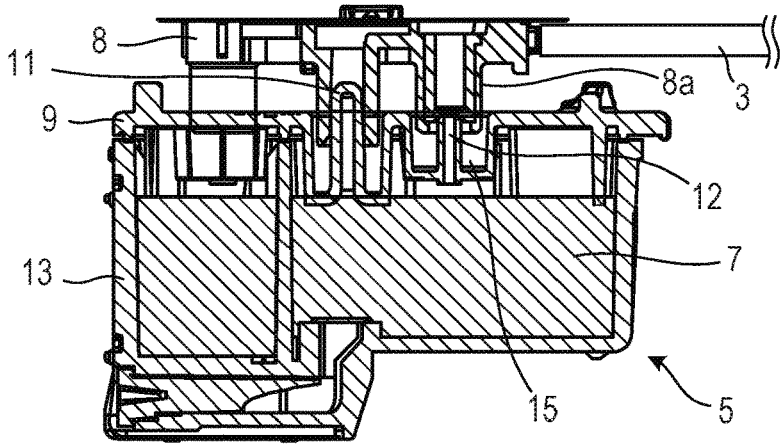
Figure 5C:
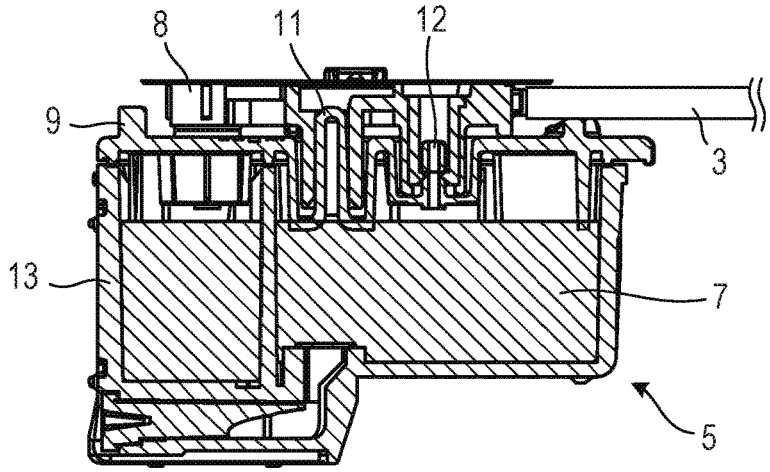

When a known liquid storage container 7 of the type under consideration such as the one described in Japanese Patent Application Laid-Open No. 2017-081078 is put to use, the sealing member 10 needs to be peeled off from the lid member 9 to expose the liquid supply ports 12 as shown in FIG. 3B in the operation of mounting the liquid storage container 7 on the carriage 4. FIGS. 5A through 5C schematically and sequentially illustrate the process of connecting the liquid storage container 7 as shown in FIGS. 3A, 3B and 4 to the joints 8. FIGS. 5A through 5C are schematic cross-sectional views of the liquid storage container 7 taken along line 4-4 in FIG. 3B. Firstly, referring to FIG. 5A, the liquid discharge head 5 is placed so as to make the lid member 9 directly face the joint 8 shown in FIG. 5A. Then, as the joint lever 20 is operated, the joint 8 starts to come down toward the lid member 9. After the joint 8 starts coming down, it then comes to contact the positioning section 11 as shown in FIG. 5B so that the joint 8 comes to be gradually positionally restricted relative to the lid member 9. Thereafter, the joint 8 keeps on coming down until its position is finalized relative to the liquid discharge head 5. Then, as a result, the liquid discharge head 5 is connected to the joint 8 and the joint 8 is brought into a state where its connecting portion 8*a* is inserted into the corresponding liquid supply port 12 of the liquid discharge head 5 as shown in FIG. 5C. In this way, a liquid flow channel from the tube 3 to the liquid storage container 7 by way of the joint 8 and the liquid supply port 12 is established.

First Embodiment

Figure 6:
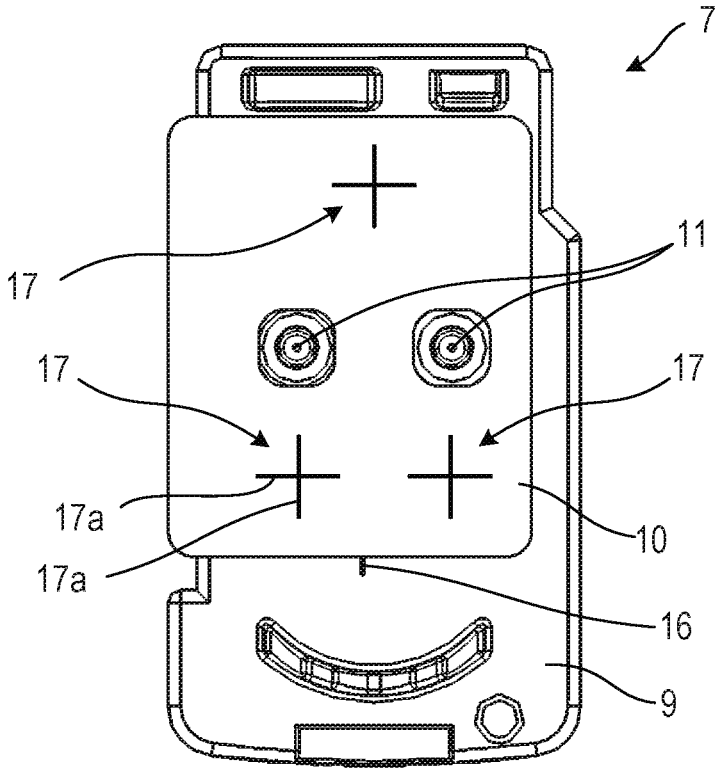
FIG. 6 is a schematic top view of the first embodiment of liquid storage container according to the present disclosure.

FIG. 6 is a schematic top surface view of the first embodiment of liquid storage container 7 according to the present disclosure. When the joints 8 are to be connected to the above-described known liquid storage container 7, the sealing member 10 applied to the top surface of the liquid storage container 7 has to be peeled off before actually connecting the joints 8 to the liquid storage container 7. To the contrary, the joints 8 can be connected to the liquid storage container 7 of the first embodiment shown in FIG. 6 without peeling off the sealing member 10.

As shown in FIG. 6, a sealing member 10 is also applied to the front surface of the lid member 9 of the liquid storage container 7 of the first embodiment. However, the liquid storage container of this embodiment differs from the known liquid storage container 7 shown in FIGS. 3A, 3B through FIGS. 5A through 5C in that cut score sections 17 are formed in given areas of the sealing member 10 of this embodiment. As described above, the sealing member 10 is applied so as to cover the recesses (concave spaces) 15 in which the liquid supply ports 12 are respectively formed and the cut score sections 17 are formed in areas of the sealing member 10 where the sealing member 10 covers the recesses 15. The cut score sections 17 are located vis-a-vis the front ends of the respective liquid supply ports 12. More specifically, each of the cut score sections 17 is so formed that its center is located on the extension extending from the center of the corresponding one of the liquid supply ports 12 and running in the direction in which the liquid supply port 12 is connected to the corresponding connecting portion 8*a* and the cut score section 17 includes the above-identified center. The expression of a "cut score section" refers to a region of the sealing member 10 where grooves, slits or cut scores are formed so as to make the sealing member 10 to be easily torn there. The cut score section 17 may be provided as linear fine grooves that extend in a direction running in parallel with the front surface of the sealing member 10 but does not allow the front surface and the rear surface of the sealing member 10 to communicate with each other through them, in other words as cut score line segments 17*a*. In FIG. 6, each of the cut score sections 17 shows a cross formed by two cut score line segments 17*a* that intersect each other and the center of the cross formed by the two cut score line segments 17*a* of the cut score section 17 is located on the extension of the center line of the corresponding one of the tubular liquid supply ports 12 that runs in the longitudinal direction of the tubular liquid supply port 12. Since the cut score section 17 is formed in the sealing member 10 at a position located right above the corresponding one of the liquid supply ports 12, the sealing member 10 is torn along the cut score line segments 17*a* with ease as the connecting portion 8*a* is moved toward the liquid supply port 12 and the sealing member 10 is pressed by the connecting portion 8*a*. Then, as a result, the connecting portion 8*a* of the joint 8 can pass through the sealing member 10 and the liquid supply port 12 and the connecting portion 8*a* can easily be connected to each other.

Figure 7A:
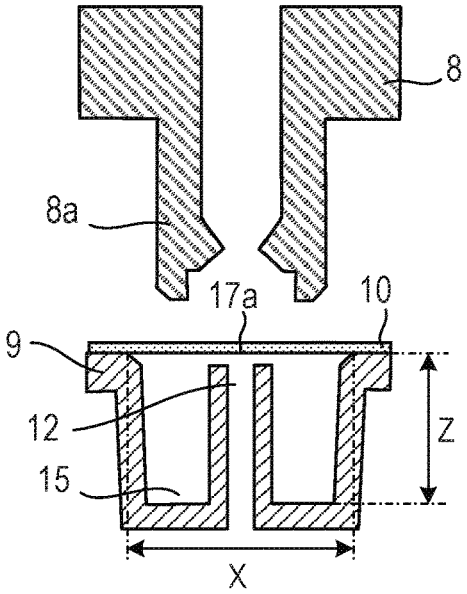
FIGS. 7A, 7B, 7C, 7D and 7E are schematic cross-sectional views of the first embodiment of liquid storage container according to the present invention, illustrating how each of the joints is connected to the liquid storage container.
Figure 7B:
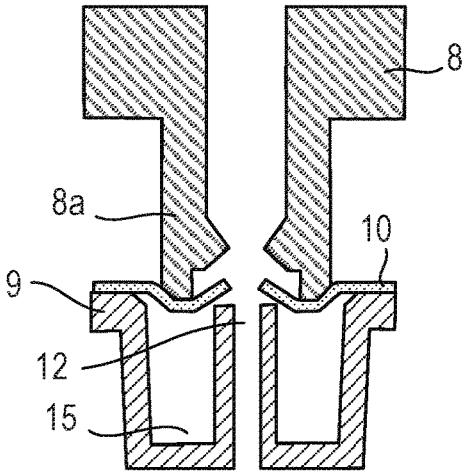
Figure 7C:
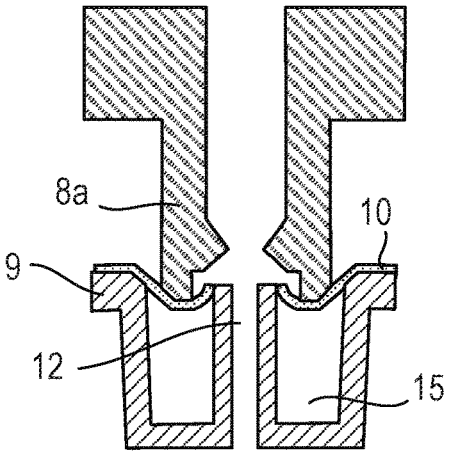
Figure 7D:
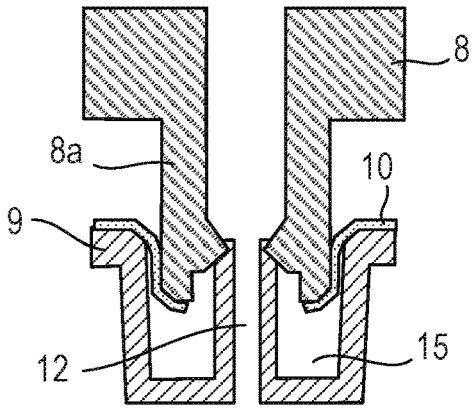
Figure 7E:
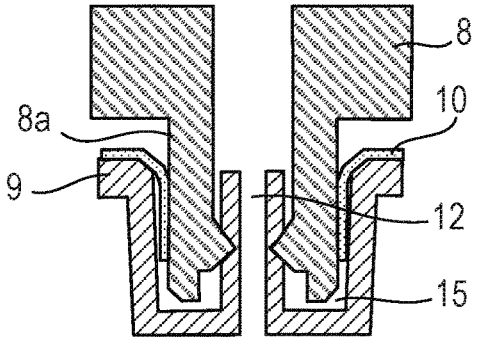

FIGS. 7A through 7E are enlarged schematic cross-sectional views of a part of the liquid storage container 7 of the first embodiment, sequentially illustrating how each of the joints 8 is connected to the liquid storage container 7. FIGS. 7A through 7E show the connecting portion 8*a* of one of the joints 8 and the corresponding one of the liquid supply ports 12 of the lid member 9 of the liquid storage container 7, including its periphery. The sealing member 10 is applied to the top surface of the lid member 9 so as to cover and seal the recesses 15 formed on the lid member 9. The sealing member 10 is provided with the cut score sections 17, each of which has its own cut score line segments 17*a*. As shown in FIG. 7A, as the joints 8 are correctly positioned relative to the liquid storage container 7 and moved downward, the front ends of the connecting portions 8*a* come down to contact and press the sealing member 10. As the sealing member 10 is subjected to the pressure, the sealing member 10 is torn from the cut score line segments 17*a* of the cut score sections 17 and deformed as a result of the tearing. Then, consequently, the connecting portion 8*a* of each of the joints 8 can get into the corresponding one of the recesses 15 as shown in FIGS. 7C through 7E. At this time, each of the small torn parts of the sealing member 10 comes to be contained in the gap produced between the inner peripheral surface of the corresponding one of the recesses 15 and the outer peripheral surface of the connecting portion 8*a* of corresponding one of the joints 8 within the recess 15. The connecting portion 8*a* ultimately gets into the innermost part of the recess 15 and the liquid supply port 12 is inserted into the connecting portion 8*a* to establish connection between the liquid storage container 7 and the joint 8.

For the purpose of allowing each of the small torn parts of the sealing member 10 to be contained in the corresponding one of the recesses 15, the relationship of $Z>X/2$ is preferably established, where X is the diameter of the recesses 15 and Z is the depth of the recesses 15. In other words, the depth Z of the recesses 15 is greater than a half of the diameter X of the recesses 15. Additionally, the length of the cut score sections 17 is preferably not less than 80% of the diameter X of the recesses 15 (not less than 0.8 times of the diameter X of the recesses). With such an arrangement, the front end of each of the small torn parts of the sealing member 10 is prevented from getting to the bottom surface of the corresponding one of the recesses 15 and snugly received in the recess 15. When, on the other hand, the relationship requirement of $X>X/2$ is not satisfied, the front end of each of the small torn parts of the sealing member 10 can get to the bottom surface of the corresponding one of the recesses 15 and may typically become bent. As a result of such bending, unnecessary external force can be applied to the connecting portions 8*a* and the liquid supply ports 12. Preferably, the thickness of the sealing member 10 is not greater than the gap formed between the inner peripheral surface of each of the recesses 15 and the outer peripheral surface of the connecting portion 8*a* of the corresponding one of the joint 8.

For the purpose of forcibly tearing and deforming the sealing member 10, pressure needs to be applied to the sealing member 10 by way of the connecting portions 8*a* of the joints 8. To minimize the pressure that needs to be applied to the sealing member 10, the cut score line segments 17*a* of the cut score sections 17 formed in the sealing member 10 preferably have a great length. Furthermore, the length of the cut score line segments 17*a* is preferably greater than the outer diameter of the front ends of the connecting portions 8*a* of the joints 8. A material that can hardly be expanded but can easily be torn is preferably employed for the sealing member 10. When a material that can easily be expanded but hardly be torn such as rubber is employed for the sealing member 10, the sealing member 10 will be expanded before the sealing member is torn apart in the cut score sections 17. Additionally, when a poorly slippery material such as rubber is employed for the sealing member 10, the pressure that needs to be applied by the connecting portions 8*a* of the joints 8 to press the sealing member 10 will increase due to friction. Therefore, preferably a material having a slippery surface is employed for the sealing member 10. In view of the above-described considerations, synthetic paper is a material that can suitably be employed for the sealing member 10 because synthetic paper possesses both the characteristics of paper and those of plastic materials and additionally it is hardly expanded but easily torn and has a slippery surface. The sealing member 10, which is a flexible member, is preferably not firm but easily broken from the viewpoint of minimizing the pressure to be applied to tear and deform the sealing member 10. The sealing member 10 preferably has a small thickness for the same token. When the sealing member 10 is made of a material that can easily be torn, the length of the cut score sections 17 may be smaller than the outer diameter of the front ends of the connecting portions 8*a*.

Second Embodiment

Figure 8:
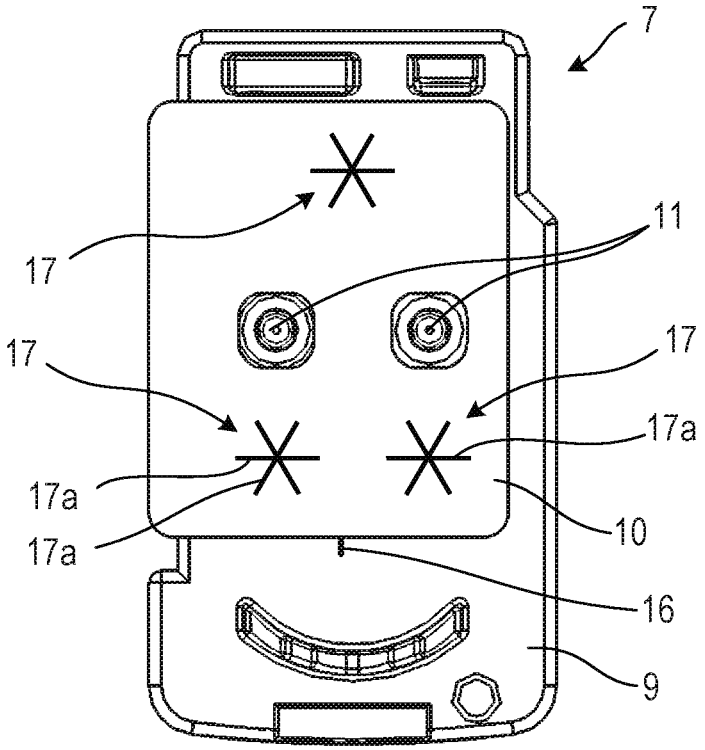
FIG. 8 is a schematic top view of the second embodiment of liquid storage container according to the present disclosure.

FIG. 8 is a schematic top view of the second embodiment of liquid storage container 7 according to the present disclosure. Cross-shaped cut score sections 17 are formed on the sealing member 10 of the above-described liquid storage container 7 of the first embodiment. However, the cut score sections 17 to be formed on the sealing member 10 are not limited to cross-shaped ones. In the liquid storage container 7 of the second embodiment shown in FIG. 8, each of the cut score sections 17 that are formed right above the respective liquid supply ports 12 has equiangularly spaced radially extending six cut score line segments, the center of the radially arranged cut score line segments being located right above the corresponding one of the liquid supply ports 12. As far as this specification is concerned, the expression of "equiangularly" includes substantially equiangularly. In other words, manufacturing errors relative to the angle that divide the radially extending cut score line segments are acceptable. More specifically, the angle separating any two adjacently located cut score line segments shown in FIG. 8 may be 60°±1°. In FIG. 6, each of the cut score sections 17 has equiangularly spaced radially extending four cut score line segments 17*a*, the center of the score line segments being located right above the corresponding one of the liquid supply ports 12. Thus, the number of cut score line segments 17*a* of each of the cut score sections 17, the center of the cut score line segments being located light above the corresponding one of the liquid supply ports 12, of the second embodiment is increased from that of the first embodiment. As the member of score line segments is increased so as to be six or more in each of the cut score sections 17, the profile of the opening that is produced by those cut score line segments as they are pressed and bent by the connecting portion 8*a* of corresponding one of the joints 8 comes from a square to a hexagon and closer to a circle than a square. In other words, as the number of the cut score line segments 17*a* is increased, the pressure applied by the connecting portion 8*a* of the joint 8 to press down the sealing member 10 can be dispersed and hence the required pressure can be reduced. However, when the number of the cut score line segments 17*a* becomes too large, the strength of the sealing member at the center of the cut score section 17 where the cut score line segments 17*a* are concentrated can unnecessarily become reduced. Then, as a result, the sealing member 10 can inadvertently and unintentionally be torn and partly turned over with ease. For the above-described reason, the number of cut score line segments 17*a* of each of the cut score sections 17 of the sealing member 10 is preferably about six or so. When a plurality of cut score line segments 17*a* are arranged radially to produce a cut score section 17 on the sealing member 10, the cut score line segments 17*a* are preferably arranged equiangularly around the center.

Third Embodiment

Figure 9A:
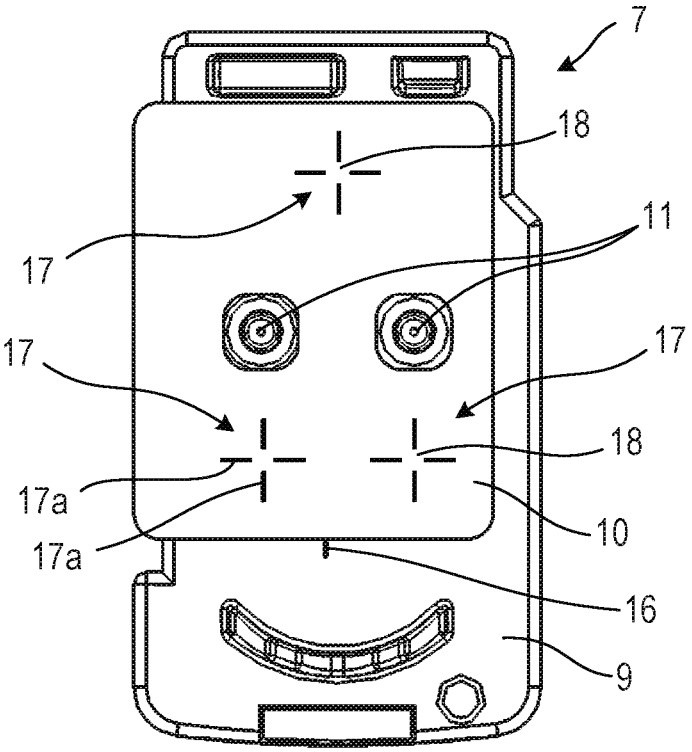
FIGS. 9A and 9B are schematic illustrations of the third embodiment of liquid storage container according to the present disclosure.
Figure 9B:
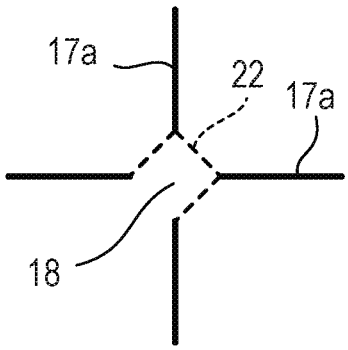

FIGS. 9A and 9B are a schematic illustration of the third embodiment of liquid storage container according to the present disclosure. FIG. 9A is a schematic top view of the liquid storage container 7 and FIG. 9B is an enlarged schematic top view of one of the cut score sections 17 of the sealing member. In each of the above-described embodiments of liquid storage container 7 according to the present disclosure, each of the cut score sections 17 formed on the sealing member 10 has a plurality of cut score line segments 17*a* that extend linearly and intersect each other at a single point, which is the center of the cut score section 17. However, the profile of the cut score sections 17 formed on the sealing member 10 is not necessarily limited to such one. In the liquid storage container 7 of the third embodiment shown in FIGS. 9A and 9B, while cut score line segments 17*a* extends linearly and are arranged radially in each of the cut score sections 17, no cut score line segments 17*a* are formed in a center area of the cut score section 17. More specifically, the cut score sections 17 of this embodiment formed on the sealing member 10 are similar to those of the first embodiment shown in FIG. 6 but, in each of the cut score sections 17 of this embodiment, no cut score line segments are formed in a given region including the center of the cut score section 17, for instance in a circular region of a given radius as measured from the center of the cut score section 17.

With the above-described cut score sections 17 of the sealing member 10 of this embodiment, assume now that the sealing member 10 is pressed by the connecting portions 8*a* of the joints 8 at the positions thereof that correspond to the connecting portions 8*a* of the joints 8. The parts of the sealing member 10 where the cut score line segments 17*a* are densely arranged in the cut score sections 17 are structurally weak so that the sealing member 10 is torn at the positions indicated by dotted lines 22 of each of the cut score sections 17 in FIG. 9B and then torn further along the cut score line segments 17*a*. The torn parts of the sealing member 10 will be turned over into the recess 15*aa* the connecting portions 8*a* are pushed further into the respective recesses 15 so as to make it possible to connect the connecting portions 8*a* to the respective liquid supply ports 12. In this embodiment, no cut score line segments 17*a* are formed in a center part of each of the cut score sections 17. In other words, the front ends that will be produced when cut score line segments 17*a* are formed so as to extend in the center part do not exist in this embodiment and the imaginary front ends are rigidly secured in position. Thus, with the liquid storage container 7 of this embodiment, the risk that the sealing member 10 is inadvertently and unintentionally torn and the torn parts of the sealing member 10 are turned over is minimized and, therefore, if liquid discharge heads 5 of the type of this embodiment are exposed to temperature and/or humidity fluctuations during the manufacturing process and/or the distribution process, their sealing members 10 stand firm against such fluctuations. In FIGS. 9A and 9B, reference numeral 18 denotes a given region located at the center of each of the cut score sections 17 where no cut score line segments 17*a* are formed. The size of the given region 18 in terms of the radius from the center, for instance, is preferably made to be as small as possible so long as the given region provides the sealing member 10 with a required level of strength. As the given region 18 is minimized, the pressure required to connect the joints 8 to the liquid storage container 7 can also be minimized.

In each of the above-described embodiments, the liquid storage container is integrally formed with the liquid discharge head that has a recording element board. However, the present disclosure can also be applied to instances where a liquid storage container is removably fitted to a liquid discharge head. Furthermore, the scope of application of a liquid storage container according to the present disclosure is not limited to liquid discharge apparatus and can find various applications other than liquid discharge apparatus.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-051133, filed Mar. 19, 2019, which is hereby incorporated by reference herein in its entirety.

What is claimed is:

1. A liquid storage container for storing liquid and receiving the liquid from a connecting portion, comprising:

a case member;

a lid member which covers a top opening of the case member, wherein the lid member has a concave space as a recess projecting inward of the case member;

a liquid supply port to be inserted into and connected to an opening of the connecting portion, wherein the liquid supply port formed in the concave space so as to extend in the direction perpendicular to a bottom surface of the concave space and have a front end located at a level below a top surface of the lid member; and a sealing member applied to the top surface of the lid member so as to cover the concave space containing the liquid supply port, wherein a cut score section is formed in an area covering the concave space of the sealing member, wherein the cut score section includes cut score line segments arranged to extend radially from a center point corresponding to a center of the liquid supply port, wherein the cut score line segments have a length greater than a diameter of the opening of the connecting portion.

2. The liquid storage container according to claim 1, wherein the cut score section includes a cut score line segment formed in the sealing member so as to extend along a surface of the sealing member.

3. The liquid storage container according to claim 1, wherein the cut score line segments are arranged to extend radially from the center point so as to divide the cut score section surrounding the center point by not less than four.

4. The liquid storage container according to claim 3, wherein the cut score line segments are arranged to extend radially from the center point so as to divide the cut score section surrounding the center point by six.

5. The liquid storage container according to claim 1, wherein the cut score section includes cut score line segments formed to equiangularly divide the area of the cut score section surrounding the center point.

6. The liquid storage container according to claim 1, wherein the concave space to which the liquid supply port is open is formed as a recess having a round opening; and wherein the cut score section is formed to be greater than the diameter of the opening of the recess on the surface.

7. The liquid storage container according to claim 6, wherein the recess is formed so as to contain the connecting portion in a state where the liquid supply port is connected to the connecting portion and to be capable of receiving broken pieces of the sealing member between an outer peripheral surface of the connecting portion and an inner peripheral surface of the recess; and wherein the recess has a depth greater than a half of the diameter of the opening thereof.

8. The liquid storage container according to claim 1, wherein no cut score line segment is formed in a predetermined area that is centered at the center point in the cut score section.

9. The liquid storage container according to claim 1, wherein the sealing member is formed by synthetic paper.

10. The liquid storage container according to claim 1, further comprising:

a recording element board for giving discharge energy to the liquid to be supplied from the liquid storage container.

11. The liquid storage container according to claim 1, wherein the liquid supply port is provided in plurality and the sealing member has a plurality of cut score sections corresponding to the number of liquid supply ports.

12. The liquid storage container according to claim 1, wherein the sealing member has an opening corresponding to a positioning hole.

13. The liquid storage container according to claim 1, the sealing member is applied to cover almost all the top surface of the lid member except one of the ends of a communication groove.

14. The liquid storage container according to claim 1, wherein the concave space is formed as a recess having an elliptic opening.

* * * * *